US009468573B2

(12) United States Patent
Edwards et al.

(10) Patent No.: US 9,468,573 B2
(45) Date of Patent: Oct. 18, 2016

(54) SLIDE AND SWIVEL TRANSFER BENCH AND METHOD

(75) Inventors: Neil Edwards, Kernersville, NC (US); James Daniels, Stokesdale, NC (US); James Allen Austin, III, High Point, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 1091 days.

(21) Appl. No.: 13/372,889

(22) Filed: Feb. 14, 2012

(65) Prior Publication Data

US 2013/0205491 A1 Aug. 15, 2013

(51) Int. Cl.

| | |
|---|---|
| ***A47K 3/02*** | (2006.01) |
| ***A61G 7/10*** | (2006.01) |
| ***A47K 3/00*** | (2006.01) |
| ***A47K 3/12*** | (2006.01) |

(52) U.S. Cl.

CPC ..... *A61G 7/1003* (2013.01); *A47K 3/003* (2013.01); *A47K 3/004* (2013.01); *A47K 3/122* (2013.01); *A61G 7/1019* (2013.01); *A61G 7/1034* (2013.01); *A61G 7/1059* (2013.01)

(58) Field of Classification Search

USPC ..... 4/578.1, 560.1–563.1, 573.1

See application file for complete search history.

(56) References Cited

U.S. PATENT DOCUMENTS

| | | | | |
|---|---|---|---|---|
| 1,076,808 | A | 10/1913 | Arburg | |
| 2,237,076 | A | 4/1941 | Kenney et al. | |
| 2,648,849 | A | 8/1953 | Webb et al. | |
| 2,965,153 | A * | 12/1960 | Purcell, Sr. | 248/240.1 |
| 3,718,365 | A | 2/1973 | Gibson | |
| 4,150,445 | A * | 4/1979 | Bailey | 4/546 |
| 4,166,297 | A * | 9/1979 | Saleeby | A47K 3/122 108/47 |
| 4,168,549 | A * | 9/1979 | Davies | 4/578.1 |
| 4,253,203 | A | 3/1981 | Thomas | |
| 4,359,791 | A | 11/1982 | Thomas | |
| 4,391,006 | A * | 7/1983 | Smith | 4/559 |
| 4,472,844 | A | 9/1984 | Mace | |
| 4,475,256 | A | 10/1984 | Hatala | |
| 4,520,515 | A | 6/1985 | Hatala | |
| 4,939,799 | A * | 7/1990 | Van Hovel | 4/578.1 |
| 5,263,207 | A | 11/1993 | Gilbert | |
| 5,373,591 | A | 12/1994 | Myers | |
| 5,606,751 | A | 3/1997 | Baker | |
| 5,740,563 | A | 4/1998 | Gaddy | |
| 5,822,809 | A | 10/1998 | Gallo | |
| 5,903,935 | A | 5/1999 | Huelke | |

(Continued)

OTHER PUBLICATIONS

U.S. Patent Application "Low Cost, Environmentally Favorable, Chromium Plate Replacement Coating for Improved Wear Performance", U.S. Appl. No. 11/653,525, filed Jan. 16, 2007.

*Primary Examiner* — Lauren Crane

(74) *Attorney, Agent, or Firm* — Carlson, Gaskey & Olds, PC

(57) ABSTRACT

A mechanism for moving into and out of an enclosure having in wall has a support having a first column for disposal inside of the enclosure on a first side of the wall and a second column for disposal outside of the enclosure on a second side of the wall. A platform for straddling the wall is disposed on the support. A seat is slidingly and rotatably arranged on the platform and has a first position on the platform for loading, a second position for allowing the user to lift a leg, and a third position wherein the user is in position for washing. A lock is disposed between the seat and the platform for locking or unlocking the seat in each of the first, second and third positions.

34 Claims, 5 Drawing Sheets

(56) References Cited

U.S. PATENT DOCUMENTS

| | | | | |
|---|---|---|---|---|
| 5,940,905 | A | 8/1999 | Cheng | |
| 6,088,847 | A | 7/2000 | Burrow | |
| 6,182,304 | B1 * | 2/2001 | Freeberg | A47K 3/122 4/560.1 |
| 6,226,810 | B1 * | 5/2001 | Weddendorf et al. | 4/579 |
| 6,240,577 | B1 * | 6/2001 | Worthy | A47K 3/122 297/217.1 |
| 6,256,806 | B1 * | 7/2001 | DiTommaso | 4/560.1 |
| 6,334,225 | B1 | 1/2002 | Brinkmann | |
| 6,681,415 | B1 | 1/2004 | Gallo | |
| 6,941,592 | B1 | 9/2005 | Castillo | |
| 7,451,501 | B2 | 11/2008 | Cheng | |
| 7,506,385 | B2 | 3/2009 | Werschmidt | |
| 7,661,154 | B2 * | 2/2010 | Cheng | 4/560.1 |
| 7,690,055 | B2 | 4/2010 | Hammer | |
| 2008/0148473 | A1 | 6/2008 | Cheng | |

* cited by examiner

SLIDE AND SWIVEL TRANSFER BENCH AND METHOD

BACKGROUND

An individual who may require a wheelchair, a walker or other assist device to facilitate movement, may find it difficult to enter, exit and be supported within a bathtub or shower. A caretaker, nurse or family member may be necessary to assist a user in getting into, out of a bathtub or shower. Seating devices assist and support individuals within a bathtub or shower.

Some bathtub seating devices take the form of a bench that is positioned between the sidewalls of the bathtub. These benches may be supported by plurality of legs extending to a bottom of a bathtub. Such benches provide a seating surface on which an individual may be placed. Some bench type seats are designed to be more simply supported on the top of the sidewalls of the bathtub and may include devices for engaging opposing sidewalls of the bathtub.

To facilitate the manner in which an individual may be positioned on a bath chair or seat, other types of bench supports may include a portion that is either mounted directly over a sidewall of the bathtub or cantilevered outwardly therefrom to provide initial support for an individual being assisted. By initially seating an individual on a cantilevered seat, the individual may thereafter be moved so that his or her legs are brought inwardly to the bathtub while their weight is supported by the seat thereafter. The individual may then be shifted along the bench within the confines of the bathtub.

Some types of prior art structures are permanently installed adjacent the bathtub or shower enclosure. Other types of portable seating devices are supported both along the bottom of the bathtub and by an adjacent floor structure. In one application, a slidable seat is mounted on a frame having a pair of legs in the bathtub and a pair of legs that engage the floor exteriorly of the bathtub.

SUMMARY

According to an embodiment disclosed herein, a mechanism for moving a into and out of an enclosure having in wall has a support having a first column for disposal inside of the enclosure on a first side of the wall and a second column for disposal outside of the enclosure on a second side of the wall. A platform for straddling the wall is disposed on the support. A seat is slidingly and rotatably arranged on the platform and has a first position on the platform for loading, a second position for allowing the user to lift a leg, and a third position wherein the user is in position for washing. A lock is disposed between the seat and the platform for locking or unlocking the seat in each of the first, second and third positions.

According to a further embodiment, a mechanism for moving into and out of an enclosure having in wall has a support having a first column disposed inside of the enclosure on a first side of the wall and a second column disposed outside of the enclosure on a second side of the wall. A platform straddling the wall is disposed on the support. A seat is slidingly arranged on the platform and has a first position on the platform for loading a user wherein the seat rotates, a second position for allowing the user to lift a leg over the wall, and a third position wherein the user is in position for washing within the enclosure. A lock is disposed between the seat and the platform for locking or unlocking the seat in each of the first, second and third positions and wherein the seat slides laterally between the second and third positions.

According to a still further embodiment, a method for entering a bathing area having a wall includes the steps of locking a bath seat in a first position outside of the area to load a user thereon, rotating and locking the bath seat in a second position over the wall wherein the user may lift a leg over the wall and sliding to and locking the seat in a third position in which the user may bathe.

These and other features of the multiple embodiments disclosed herein can be best understood from the following specification and drawings, the following of which is a brief description.

DETAILED DESCRIPTION

Figure 1:
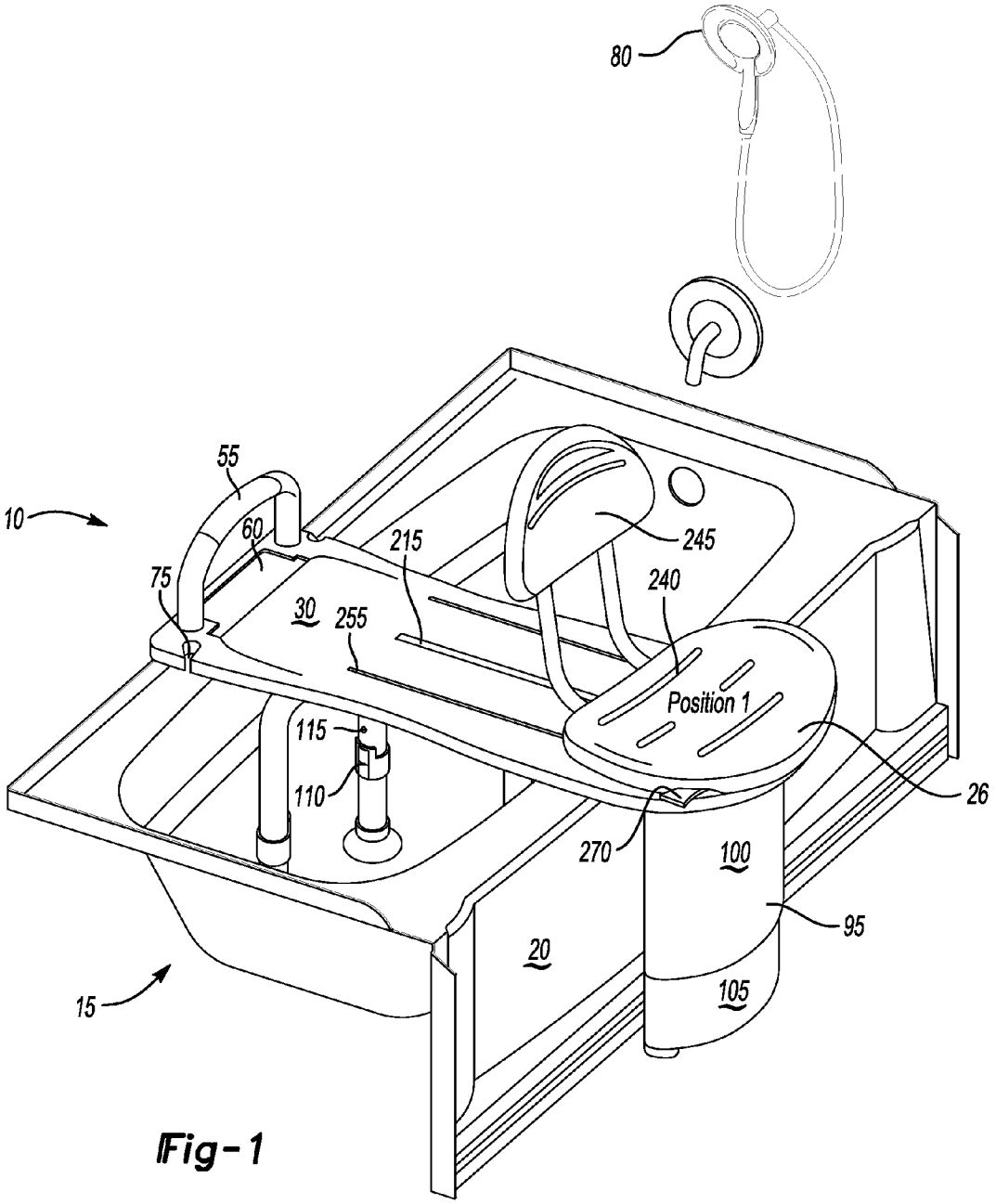
FIG. 1 is a perspective view of a sliding shower and bath seat.
Figure 1A:
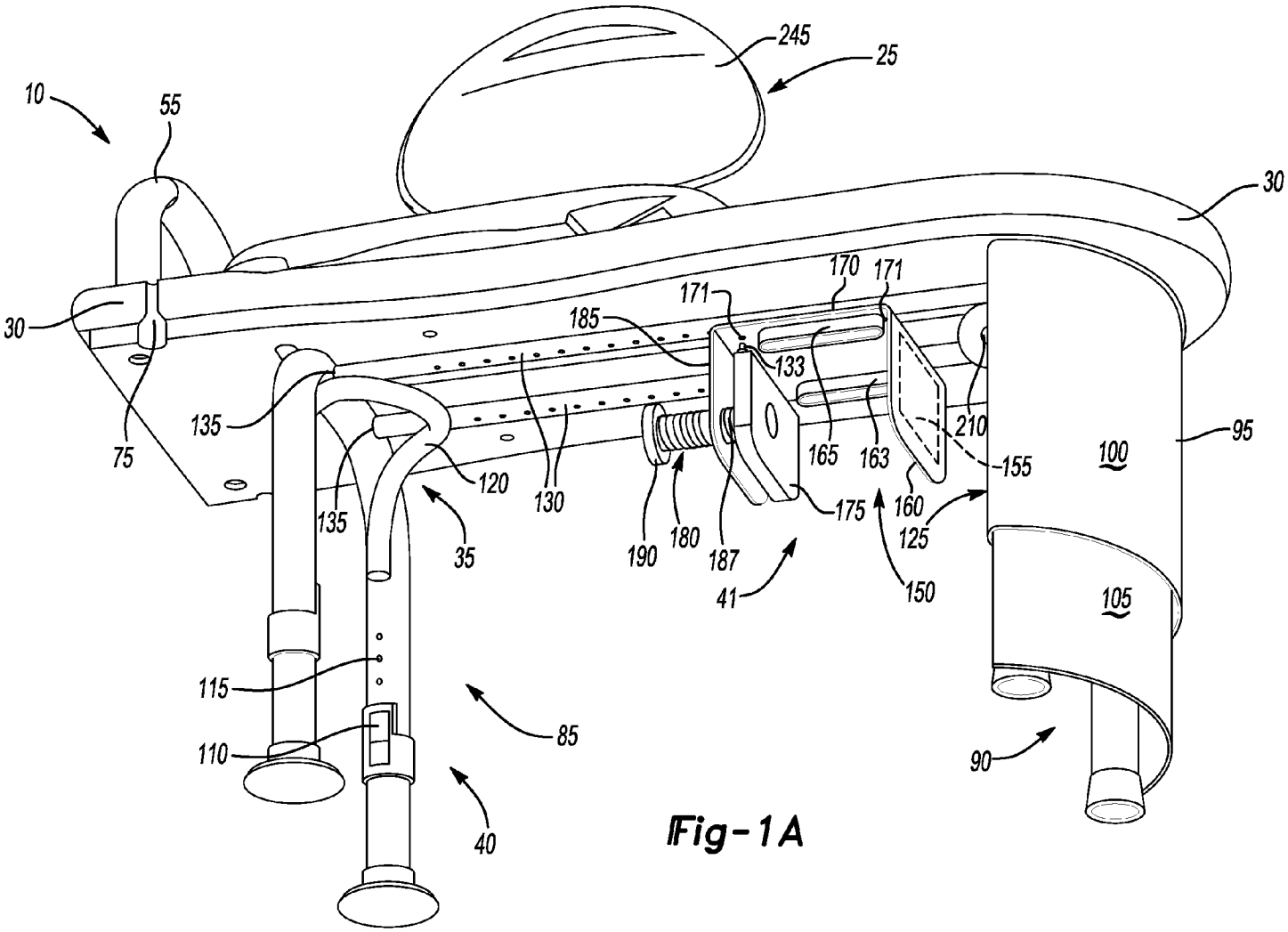
FIG. 1A is a perspective view of the sliding bath and shower seat of FIG. 1.

Referring now to FIGS. 1 and 1A, a sliding bench device 10 for an enclosure 15 such as a bathtub/shower as shown. It should be noted that the sliding bench device 10 is useable in any situation where a user (not shown) is seated, passed over an impediment such as a wall 20, and passed back over the impediment. The user's seat 25 may be turned while passing over the impediment and the user may be treated (i.e., showered or bathed) while in the enclosure 15.

The device 10 includes the seat 25, a slide table 30, a support section 35 for holding the slide table 30, legs 40 depending from the support section 35, and a clamp mechanism 41 (see FIG. 1A) depending from the support section 35 and for clamping the device 10 to the wall 20.

The seat 25, which is rotatable within the slide table 30, has a contoured seat bottom 26 and a seat back 45, a locking mechanism 50 (see FIG. 2A) for locking the seat 25 in position for the user and unlocking the seat 25 so that the seat 25 may be rotated and slid along the slide table 30 to the proper position for use and loading or unloading by a user.

The slide table 30 has a molded-in grab bar 55, an accessory plate 60 for holding items (not shown) such as a shower head or a tooth brush, and a groove 75 that may hold a portable shower head 80.

The legs 40 (e.g., support columns) are adjustable upwardly and/or downwardly from the slide table 30 and form a first pair of legs 85 disposed inside of and a second pair of legs 90 disposed outside of the enclosure 15. The second pair of legs 90 outside the tub is covered by a skirt 95 that has several functions; to act a decorative cover, to minimize a probability that the user might knock against the second pair legs 90 and either dislodge them or hurt themselves; and to minimize clothing entanglements with the second pair legs 90 outside of the enclosure 15. The skirt 95 has an upper panel 100 and a lower panel 105 fitting closely within the upper panel 100 so that they form an interference fit with each other to allow the lower panel 105 to be pulled upwardly and downwardly to cover the second pair of legs 90 as may be required. Each of the pairs of legs telescope within themselves and are held by pegs 110, or the like, that fit in holes 115 to allow adjustment of the length of the legs as is known in the art.

Referring to FIGS. 1A and 1B, the support section 35 includes an inside channel 120 and an outside channel 125 that connect, by brazing or gluing, to the first pair of legs 85 and the second pair of legs 90 respectively. Each of the channels 120 and 125 also attach to a pair of reinforcing rods 130 that also extend into holes 135 in the first pair of legs 85 and the second pair of legs 90 respectively.

Figure 2:
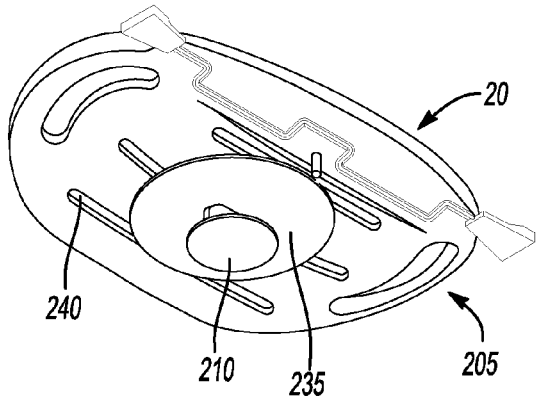
FIGS. 2 and 2A provide a view of an underside of a sliding seat and an underside of a sliding seat that is partially exploded.
Figure 2:
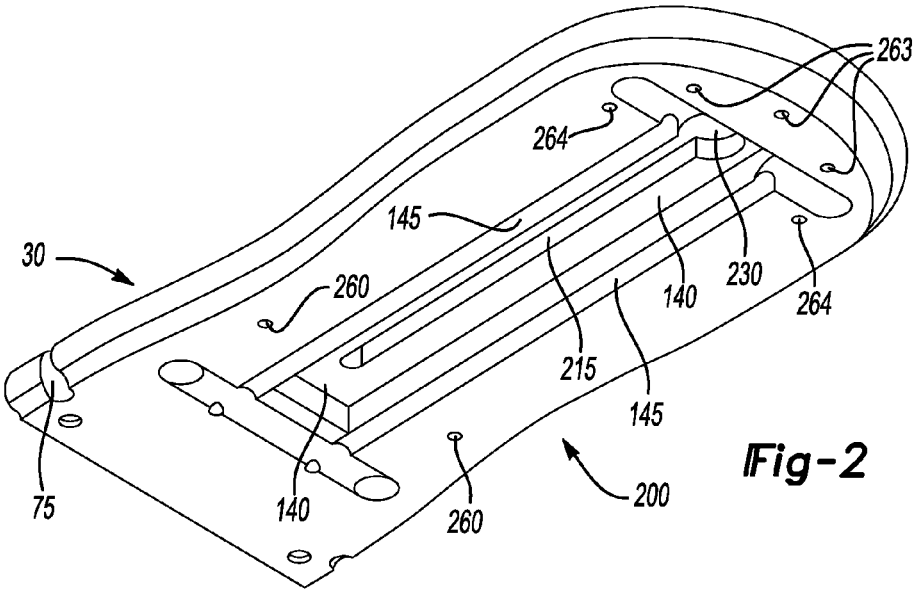

The pair of reinforcing rods 130 also provides support and snaps into the sliding table 30 outwardly from a lower glide recess 140 within grooves 145 as is shown in FIG. 2 and as will be discussed herein. The rods have holes 131 for receiving screws 133 as will be discussed infra. The legs provide support for the device 10. The first pair of legs 85 and the second pair of legs 90 are to be placed within and without the enclosure 15 respectively. The adjustable nature of each of the first pair of legs 85 and the second pair of legs 90 permits a user to level the device 15 to provide the sliding of the seat 25 within the slide table 30 as will be discussed hereinbelow.

A U-shaped bracket 150 of the clamp mechanism 41 is conventionally attached to the pair of reinforcing rods 130 of the support section 35. The U-shaped bracket 150 has a first pad 155 affixed to an outside leg 160 thereof, several second pads 165 on a top surface 170 thereof and a third pad 175 that attaches to an axially moveable screw 180 on an inside leg 185 thereof. The bracket 150 has a plurality of openings 171 for admitting screws 131 therethrough to anchor the bracket 150 to the reinforcing rods 130 via holes 131. The number of holes 131 allows a user to place the device 10 in a desired location. Rotation of the screw 180 clamps a wall 20 of an enclosure 15, such as a tub or a raised shower wall therebetween to anchor the device 10 within the enclosure 15 from movement. The screw 180 moves through a nut 187 extending through the inside leg 185 and is driven by a rotatable knob 190 as is known in the art to clamp or unclamp the device 10 from the wall 20.

Figure 2A:
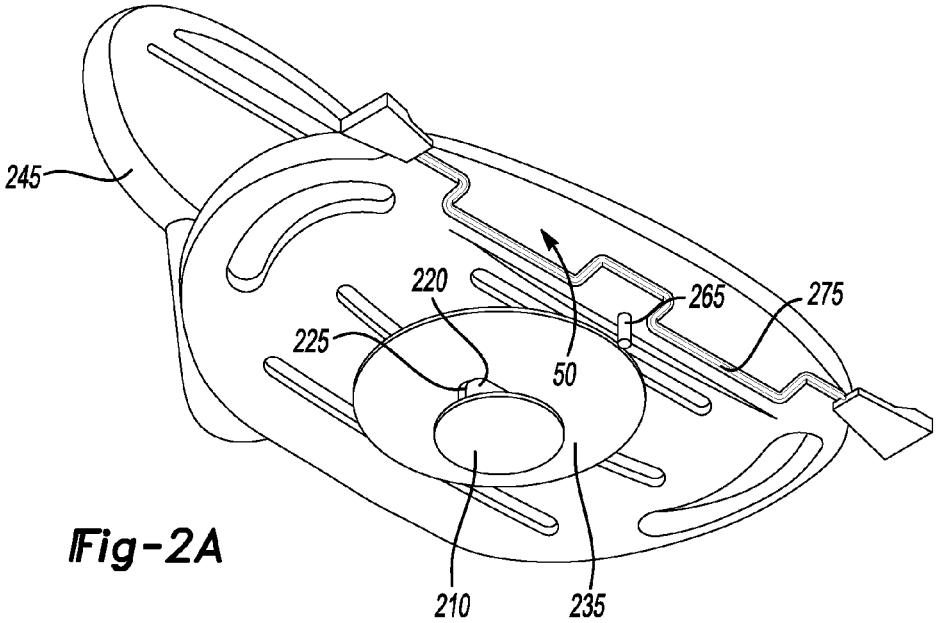

Referring now to FIGS. 2 and 2A, a lower surface 200 of the slide table 30 and a bottom surface 205 of the seat 25 are shown. The slide table 30 has a lower glide recess 140 in which a bearing 210 from the seat 25 is disposed. A slot 215 in the slide table 30, guides a roughly rectangular flange 220 depending from the seat 25 bottom that has rounded edges 225 at distal ends thereof. The slot 215 allows rotation of the chair and the guide turn section 230 which has a diameter that is roughly analogous to a length of the flange 220. The slot 215 has a width that is roughly analogous to the width of the flange 220 so that the seat 25 slides guided by flange 220 the slot 215 but will not turn unless the seat 25 is above the guide turn section 230 is which the flange 220 has room to rotate. In essence, the slot 215 and its guide turn section 230 form a key hole slot to allow the rectangular flange 220 to act as a key that enters in and may turn in the guide turn section 230 and may slide in the slot 215.

The seat 25 has an upper glide bearing 235 attached to the bottom surface 205, a plurality of slots 240 extending through the bottom surface 205 to allow water to drain therethrough, a seat back 245, and a pair of supports 250 that attach the seat back 245 to the seat 25 as is known in the art. The guide bearings 235 and 210 are made of a plastic material that is slippery relative to the material in the slide table 30 so that rotation of the seat 25 and sliding of the seat 25 on the slide table 30 is relatively easily achieved.

The slide table 30 has a groove 255 in which a plurality of inner lock holes 260 and a plurality of outer lock holes 263 are disposed therein so that if the seat 25 is not in axially or rotatably in transition along the slide table 30, the seat 25 may be locked into position for loading, unloading, and/or washing. The number of holes shown is illustrative only and the number of holes may vary.

Each seat 25 has an anti-rotation/lock pin 265 that is disposed within the lock holes of the seat 25 if not in transition as stated hereinabove. The user may pull handle 270 upwardly on either side of the seat 25 to free the seat 20 for movement. Referring to FIG. 2B, if the handle 270 is lifted upwardly against the force of spring 272 that is mounted in the seat 20, the lever 275, or the like, rotates about an axis 280 to move the pin 265 out of a lock hole 260, 263, 264. If lifted, the lever drives an end 285 of an intermediate lever 290 against a flange 295 attaching to the pin 265. The flange 295 then drives the pin 265 upwardly in opening 297 against the force of spring 300, out of lock holes 260, 263, 264. If the lever is not lifted, the pin 265 is urged downwardly in the slot to the lock hole 260, 263, 264 by the spring 300 and the lever 270 is driven to its initial state by the spring 272. Other mechanisms to lift the pin 265 via a manipulated lever 275 are contemplated herein.

Figure 3:
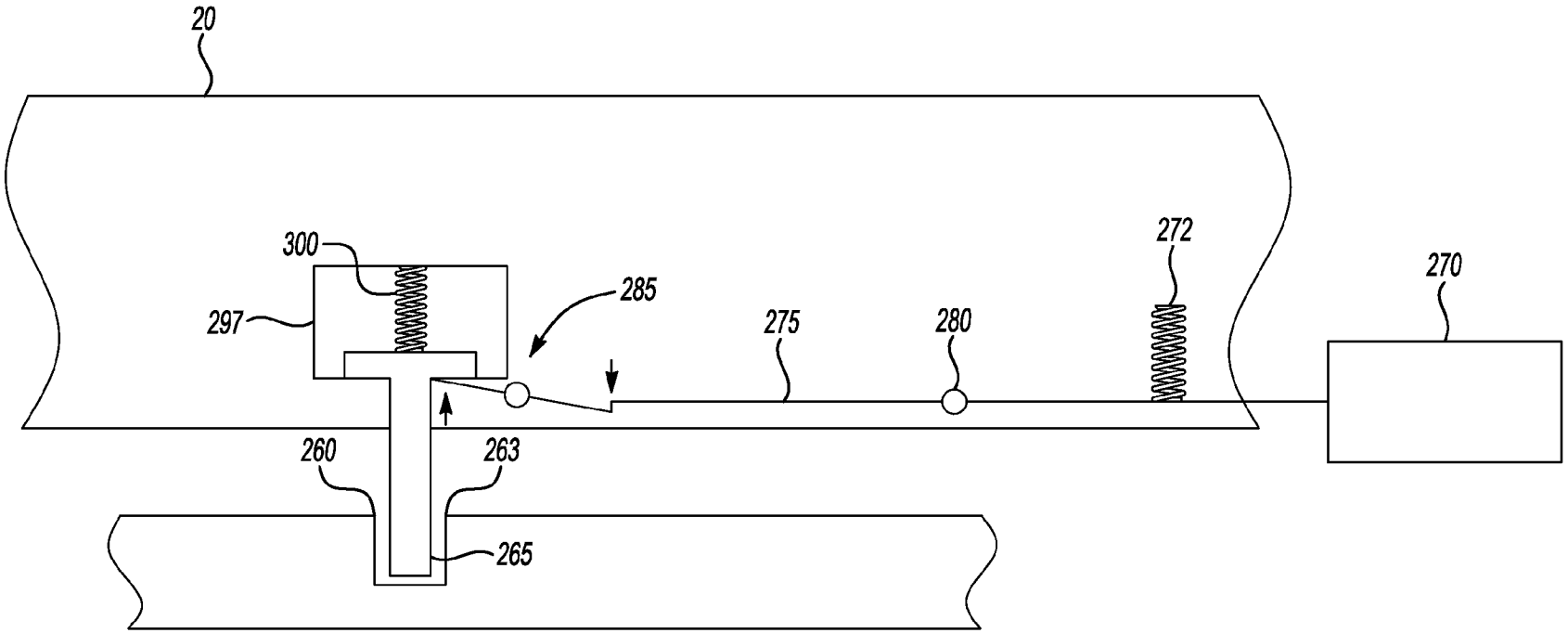
FIG. 3 is an underside of the bottom of the shower schematic view.
Figure 4:
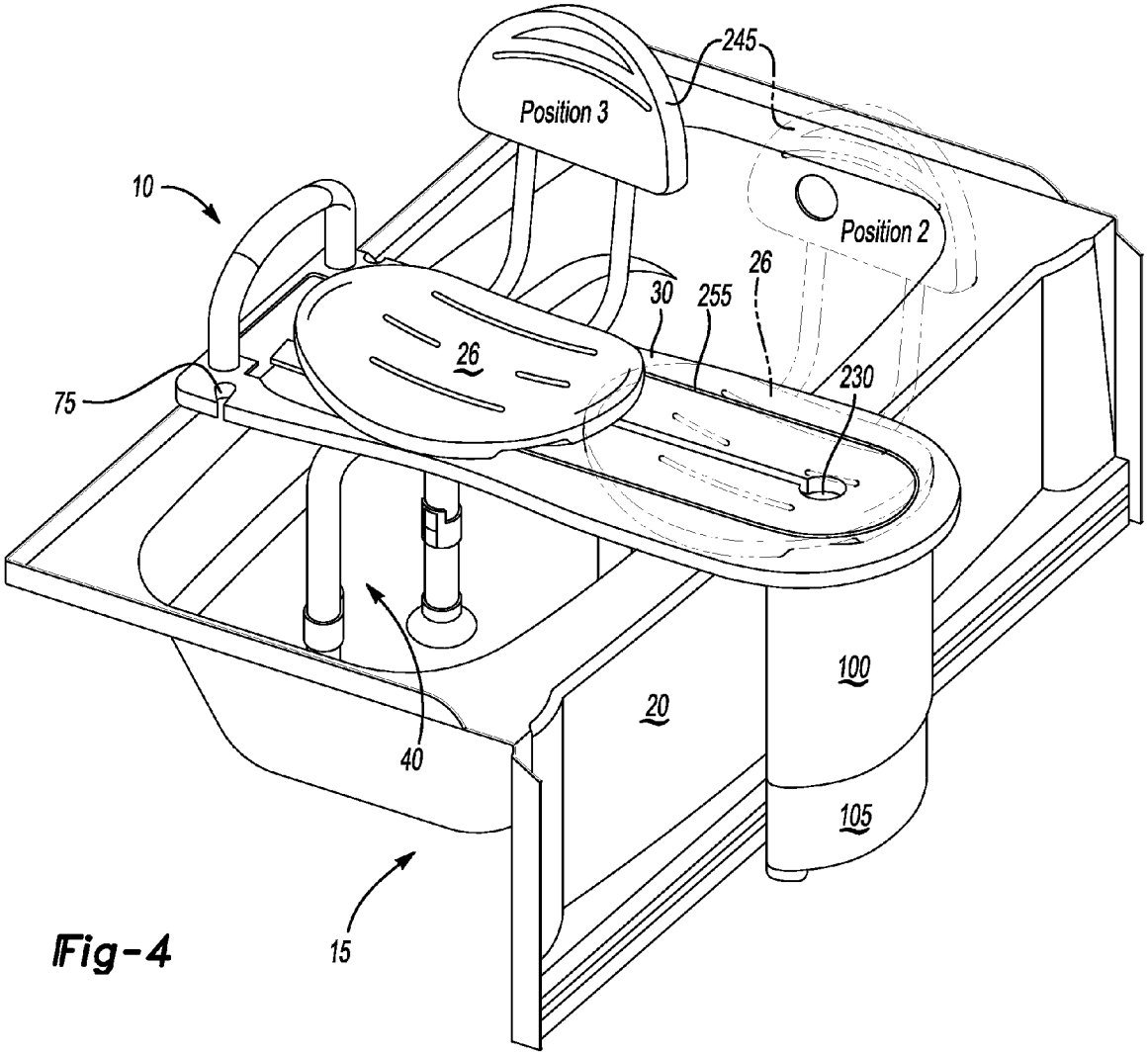
FIG. 4 is another perspective view of the shower seat of FIG. 1.

In operation, the seat 25 is disposed outside the enclosure with the seat 25 facing outwardly and away from the enclosure 10 (See FIG. 1). This is position 1. The pin 265 is disposed in one of the lock holes 263 that are disposed along a circumference to accommodate any special needs, or supports like crutches or wheelchairs (not shown) of the user. The user is then seated on the seat 25. Depending on the direction a user or an aid wishes the user to face, the handle 270 is manipulated to raise the anti-rotation lock pin 265 out of the lock hole 263 to allow the flange 220 to rotate so that the length of the flange 220 is aligned for sliding in slot 215. Because the lever 275 is spring driven or springy acting on the anti-rotation lock pin 265 each time a user reaches a point where the length of the flange 220 is aligned for sliding in slot 215, the pin falls into a lock hole 264 stabilizing the seat to allow a user to manipulate his or her legs over the wall 20 (see FIG. 3). This is position 2. Once a user is within the enclosure, the anti-rotation lock pin 265 falls into a hole 260 and locks the seat 25 in the proper position for washing (see FIG. 3). This is position 3.

To remove a user, the process is reversed. The lock pin 265 is lifted to allow the seat 25 to be moved axially towards the outside of the enclosure from position 3 to position 2. Once the seat 25 is in the position 2 in which a user's legs may be lifted over the tub wall, the pin drops into a lock hole 264 after which the user removes his legs from the enclosure 15. The user then lifts the lock slot again and aligns the seat 25 within so that the flange is within the slot guide turn section 230 and the lock pin 265 falls in one of the holes 263 to allow the seat 25 to turn outwardly and allow a user to exit from the seat 25 now in position 1.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A mechanism for moving into and out of an enclosure having a wall, said mechanism comprising:

a support having a first column for disposal inside of said enclosure on a first side of said wall and a second column for disposal outside of said enclosure on a second side of said wall, a platform disposed on said support, said platform for straddling said wall, a seat sliding arranged on said platform having a first position on said platform for loading wherein said seat rotates, a second position for allowing said user to lift a leg, and a third position wherein said user is in position for washing, a lock disposed between said seat and said platform for locking or unlocking said seat in each of said first, second and third positions.

2. The mechanism of claim 1 further comprising:

a clamp for anchoring said platform to said wall, said clamp depending from said support contiguous to said second position, and wherein said lock is configured to lock said seat in said second position to allow a user to lift at least one leg over the wall prior to moving to the third position.

3. The mechanism of claim 2 wherein said clamp further comprises a fixed first panel and a second panel that is moveable from a first position to a second position for holding said wall between said first panel and said second panel.

4. The mechanism of claim 3 wherein said movable wall is driven by a control disposed between said second position and said first position.

5. The mechanism of claim 1 wherein said lock comprises:

a retractable pin depending from said seat, a first hole in said platform in said first position, a second hole in said platform in said second position and, a third hole in said platform in said third position wherein said seat is not moveable if said pin is engaged in one of said first, second or third holes and moveable if said pin is not engaged in one of said first, second or third holes.

6. The mechanism of claim 5 further comprising:

a handle connecting to said pin to retract said pin into and out of engagement of one of said first, second or third holes.

7. The mechanism of claim 6 further comprising:

a lever disposed between said handle and said pin to allow said pin to move linearly into and out of engagement with one of said first, second or third holes.

8. The mechanism of claim 7 wherein said lever is spring loaded.

9. The mechanism of claim 1 wherein each of said first and second column is adjustable vertically.

10. The mechanism of claim 9 wherein said second column is covered by a skirt.

11. The mechanism of claim 10 wherein said skirt comprises at least first and second panels, wherein one of the first and second panels is adjustable vertically relative to the other of the first and second panels to selectively cover said second column.

12. The mechanism of claim 1 wherein said platform includes a slot for holding a shower head.

13. A mechanism for moving into and out of an enclosure having in wall, said mechanism comprising:

a support having a first column disposed inside of said enclosure on a first side of said wall and a second column disposed outside of said enclosure on a second side of said wall, a platform disposed on said support, said platform straddling said wall, a seat sliding arranged on said platform having a first position on said platform for loading a user wherein said seat rotates, a second position for allowing said user to lift a leg over said wall, and a third position wherein said user is in position for washing within said enclosure, a lock disposed between said seat and said platform for locking or unlocking said seat in each of said first, second and third positions and wherein said seat slides laterally between said second and third positions.

14. The mechanism of claim 13 further comprising;

a clamp for anchoring said platform to said wall, said clamp depending from said support above said second position, and wherein said lock is configured to lock said seat in said second position to allow a user to lift at least one leg over the wall prior to moving to the third position.

15. The mechanism of claim 14 wherein said clamp further comprises a fixed first panel and a second panel that is moveable from a first position to a second position for holding said wall between said first panel and said second panel.

16. The mechanism of claim 15 wherein said movable wall is driven by a control disposed inside of said enclosure.

17. The mechanism of claim 13 wherein said seat slides within a key hole slot in said platform, wherein said key hole slot comprises a slot portion extending in a lateral direction to terminate at a guide turn section that is positioned adjacent said first column and outside of said enclosure.

18. The mechanism of claim 17 wherein a disk attaches to a key that attaches to said seat wherein said key is free to slide in said slot and said disk is on an opposite side of said platform from said seat.

19. The mechanism of claim 18 wherein said key and said seat may rotate in said guide turn section of said key hole slot in said first position.

20. The mechanism of claim 13 wherein said lock comprises:

a retractable pin depending from said seat, a first hole in said platform in said first position, a second hole in said platform in said second position and, a third hole in said platform in said third position wherein said seat is not moveable if said pin is engaged in one of said first, second or third holes and moveable if said pin is not engaged in one of said first, second or third holes.

21. The mechanism of claim 20 further comprising:

a handle connecting to said pin to retract said pin into and out of engagement of one of said first, second or third holes.

22. The mechanism of claim 21 further comprising:

a lever disposed between said handle and said pin to allow said pin to move linearly into and out of engagement with one of said first, second or third holes.

23. A method for entering a bathing area having a wall comprising the steps of:

locking a bath seat in a first position outside of said area to load a user thereon, rotating said bath seat in said first position, sliding said seat from said first position to a second position over said wall, locking said bath seat in said second position wherein said user may pass over said wall, sliding said seat past said wall, and locking said seat in a third position in which said user may bathe.

24. The method of claim 23 further including:

using a single locking mechanism for locking the seat in the first, second, and third positions such that said lock is configured to lock said seat in said second position to allow a user to lift at least one leg over the wall prior to moving to the third position.

25. The method of claim 24 wherein the single locking mechanism comprises at least one protrusion extending outwardly from a bottom surface of the seat, a first set of openings circumferentially spaced apart from each other to define the first position, and a second set of openings axially spaced apart from each other to define the second and third positions, and further including:

inserting the protrusion in an opening of the first set of openings to lock the seat in the first position;

releasing the protrusion from the opening of the first set of openings, rotating the seat to the second position, and inserting the protrusion into an opening of the second set of openings to lock the seat in the second position; and releasing the protrusion from the opening of the second set of openings, sliding the seat to the third position, and inserting the protrusion into another opening of the second set of openings to lock the seat in the third position.

26. The method of claim 25 further including:

providing a support structure with an upper surface and a lower surface;

forming at least one groove in the upper surface;

forming the first and second sets of openings in the groove;

forming a glide recess and a slot having an enlarged opening at one end thereof in the bottom surface, the enlarged opening forming a turn section;

providing an upper bearing and a lower bearing on a bottom of the seat, the upper and lower bearings being connected by a flange;

installing the upper bearing between the upper surface of the support structure and the bottom of the seat, with the flange being received in the slot and the lower bearing being received in the glide recess.

27. The mechanism of claim 1 wherein said lock comprises a single lock mechanism that is configured to lock and unlock in each of said first, second, and third positions.

28. The mechanism of claim 27 wherein said platform has an upper surface and a lower surface, and further including:

at least one groove formed in the upper surface;

a first set of openings formed in the groove and circumferentially spaced apart from each other to lock the seat in the first position;

a second set of openings formed in the groove and axially spaced apart from each other to lock the seat in the second and third positions;

a glide recess and a slot having an enlarged opening at one end thereof formed in the bottom surface, wherein the enlarged opening forms a turn section positioned on said second side of said wall to allow the seat to rotate; and an upper bearing and a lower bearing attached to a bottom of the seat, the upper and lower bearings being connected by a flange, and wherein the upper bearing is positioned between the upper surface of the support structure and the bottom of the seat, with the flange being received in the slot and the lower bearing being received in the glide recess.

29. The mechanism of claim 13 wherein said lock comprises a single lock mechanism that is configured to lock and unlock in each of said first, second, and third positions, said single lock mechanism comprising at least one protrusion extending outwardly from a bottom of the seat, a first set of openings formed in the platform to lock the seat in the first position, wherein the first set of openings allow the seat to be locked in two different rotational positions, and a second set of openings formed in the platform to lock the seat in the second and third positions, wherein the openings of the second set of openings are axially spaced apart from each other.

30. A mechanism for moving into and out of an enclosure having a wall, said mechanism comprising:

a support structure having at least one first leg configured to be disposed inside of the enclosure on a first side of the wall and at least one second leg configured to be disposed outside of the enclosure on a second side of the wall;

a slide structure disposed on said support structure, said slide structure extending across the enclosure and overhanging said wall;

a seat arranged to rotate on said slide structure from a first position where said seat is outside the enclosure to a second position that straddles the wall, and then slide to a third position located within the enclosure; and a single locking mechanism disposed between said seat and said slide structure for locking or unlocking said seat in each of said first, second and third positions.

31. The mechanism of claim 30 wherein said single locking mechanism comprises at least one protrusion extending outwardly from a bottom surface of the seat, a first set of openings configured to receive the at least one protrusion to lock the seat in the first position, and a second set of openings configured to receive the at least one protrusion to lock the seat in said second and third positions, and wherein openings of the first set of openings define different rotational lock positions for the seat and openings of the second set of openings define different axial lock positions for the seat.

32. The mechanism of claim 31 wherein said slide structure has an upper surface and a lower surface, and further including:

at least one groove formed in the upper surface, wherein the first and second sets of openings are located within the groove;

a glide recess and a slot having an enlarged opening at one end thereof formed in the bottom surface, the enlarged opening forming a turn section to allow the seat to rotate;

an upper bearing and a lower bearing mounted to a bottom of the seat, the upper and lower bearings being connected by a flange, and wherein the upper bearing is positioned between the upper surface of the slide structure and the bottom of the seat, with the flange being received in the slot and the lower bearing being received in the glide recess.

33. The mechanism of claim 32 wherein the groove comprises a U-shape having first and second axial groove portions extending respectively along opposing sides of the slide structure, with one end of the first and second axial groove portions being connected to each other with a curved groove portion to provide an uninterrupted U-shaped groove.

34. The mechanism of claim 30 wherein said seat slides within a key hole slot in said slide structure, wherein said key hole slot comprises a slot portion extending in a lateral direction to terminate at a guide turn section that is positioned adjacent said at least one first leg and outside of said enclosure.

* * * * *